US005636821A

United States Patent [19]

Davies

[11] Patent Number: 5,636,821

[45] Date of Patent: Jun. 10, 1997

[54] DISPLAY CARD

[75] Inventor: Philip Davies, Victoria, Australia

[73] Assignee: Cooper Tools Pty Limited, New South Wales, Australia

[21] Appl. No.: 561,847

[22] Filed: Nov. 22, 1995

[30] Foreign Application Priority Data

Nov. 24, 1994 [AU] Australia ..... PM9652

[51] Int. Cl.[6] ..... A47H 1/10

[52] U.S. Cl. ..... 248/300; 248/551

[58] Field of Search ..... 248/300, 551; 40/617, 124.1

[56] References Cited

U.S. PATENT DOCUMENTS 4,131,229 12/1978 Nastasi ..... 229/39 R 4,230,259 10/1980 Herzog ..... 229/38

4,586,279 5/1986 Hopkins ..... 40/124.1

FOREIGN PATENT DOCUMENTS 614477 11/1989 Australia .

645471 2/1993 Australia .

*Primary Examiner*—Leslie A. Braun

*Assistant Examiner*—Willie Berry, Jr.

*Attorney, Agent, or Firm*—Burns, Doane, Swecker & Mathis LLP

[57] ABSTRACT

A display card 5 for tools 1 having belt hooks 4 comprises a card 5 of foldable material. The card 5 is slotted so as to form a flap 2 and a tongue 6. The flap 2 is adapted to admit the belt hook 4 of the tool 1. The tongue 6 is adapted so as to be folded towards the flap 2. The tongue 6 is hingedly connected to the card 5, and comprises a tab 3 which is inverted when the tongue 1 is folded towards the flap 2.

15 Claims, 2 Drawing Sheets

DISPLAY CARD

BACKGROUND OF THE INVENTION

1. Field of the Invention

The present invention relates to theft deterrent devices, and, in particular, to a theft deterring display card for tools having belt clips or books, such as measuring tapes. Further, this invention also relates to a theft deterring method of displaying and storing such tools.

2. Description of Related Art

Shoplifting is a major problem for shopkeepers and their staff. Shoplifters must be very quick to conceal goods without attracting the attention of staff, before removing the goods from the store.

Consequently, some items, such as tools, are often displayed attached or blister packaged on larger display cards. The larger display card and blister packaging acts as an obstacle to a would-be thief. However, it is often difficult for a genuine customer to remove the item from the display card after purchasing the item, even more so if it is blister packaged.

SUMMARY OF THE INVENTION

It is an object of the present invention to overcome or substantially ameliorate the above disadvantages through provision of a theft deterring display card for tools with belt hooks, such as tape measures.

The present invention in one broad form provides a display card for tools having belt hooks, comprising a card of foldable material, slotted so as to define a flap and a tongue, wherein the flap is adapted to admit a belt clip of a tool; and the tongue is adapted to be folded towards the flap. The tongue is hingedly attached to the card and further comprises a tab adapted such that when the tongue is folded towards the flap, the tab of the tongue is inverted.

Preferably, the tab is adapted to engage a slot or aperture in the belt clip when the hook is inserted through the card.

The invention in another broad form provides a method of storing and/or displaying a tool having a belt clip, including the steps of providing a display card, such as one described above, folding a tongue of the display card towards the flap; inserting the belt clip of a tool through the flap; and engaging the tab of the tongue with a slot or aperture in the belt clip.

Preferably, the display card and tool are then displayed by hanging, via the hole in the display-card.

BRIEF DESCRIPTION OF THE DRAWINGS

A preferred embodiment of the present invention will now be described, by way of example, with reference to the following drawings, wherein.

DETAILED DESCRIPTION OF PREFERRED EMBODIMENTS

Figure 1:
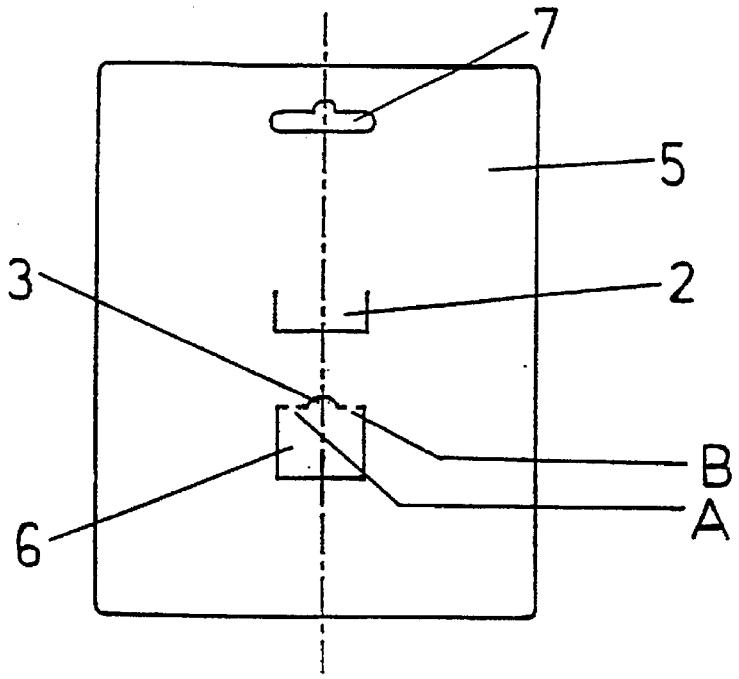
FIG. 1 is a front view of a display card.
Figure 2:
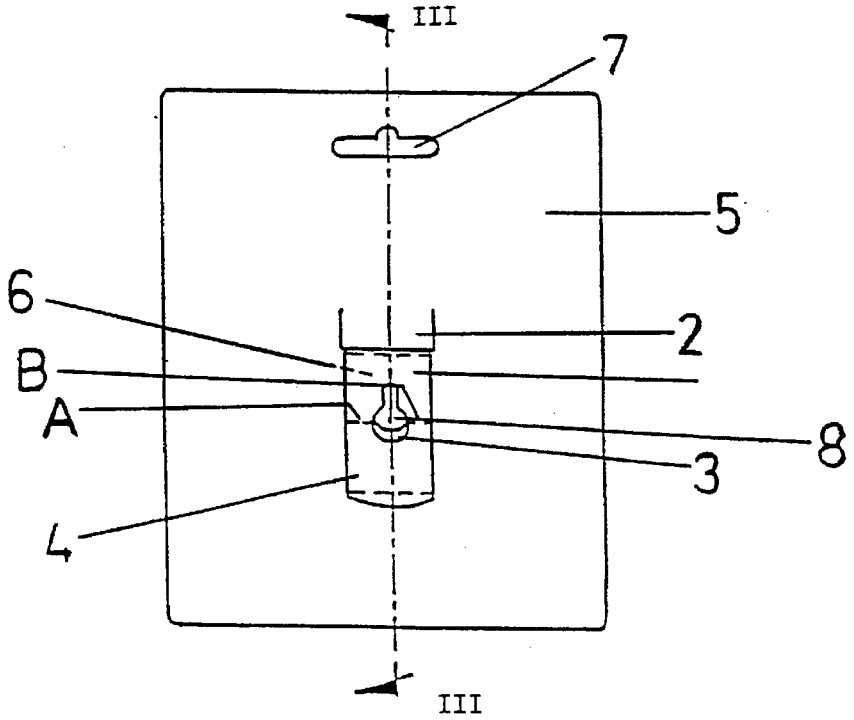
FIG. 2 is a back view of the display card of FIG. 1 with a belt clip of a tool inserted therein.

Referring to FIG. 1, a display card 5 is shown.

In this preferred embodiment, a flap 2 and a tongue 6 are substantially rectangular in shape. A tab 3 of the tongue 6 is rounded in shape. The tongue 6 remains attached to the card 5 at locations A and B, and can be folded towards the flap 2, causing the tab 3 to project away from the flap 2.

Figure 3:
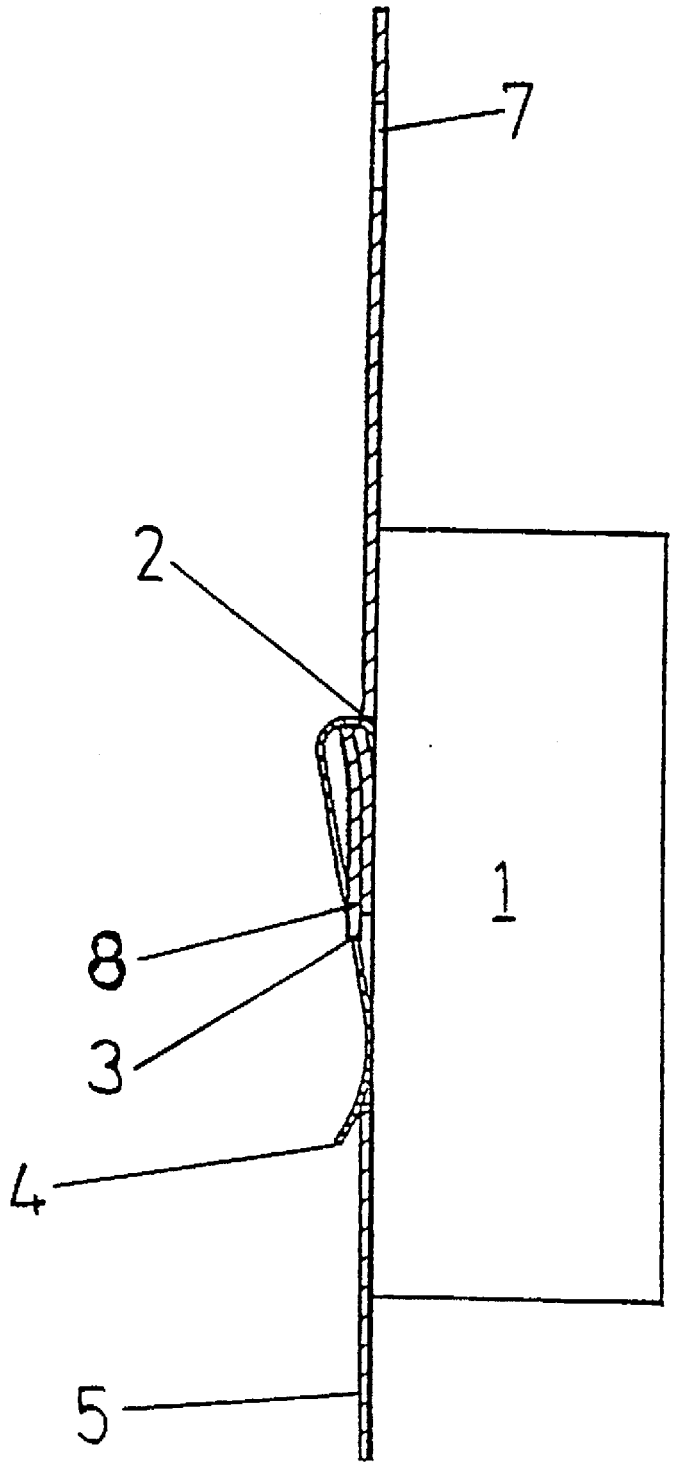
FIG. 3 is a cross-sectional view of the display card of FIG. 1, taken through line III—III, including a tape measure.

The flap 2 is cut as a substantially U-shaped cut in the card 5 to facilitate a belt clip 4 passing through. The flap 2 can be tucked in between a measuring tape case 1 and the belt clip 4 after the belt clip 4 has been positioned in the card 5. See FIG. 3. This arrangement impedes the belt clip's withdrawal.

The tongue 6 is also cut into the card 5 in a position below the flap 2 described above. The tongue 6 is hinged at points A and B, with the tab 3 cut in between.

In operation, the tongue 6 is pushed out and folded back toward the flap 2 before the belt clip 4 is positioned, thus forming a double card thickness under the clip 4. See FIG. 3. When the tongue 6 is folded up towards the flap 2, the tab 3 is inverted by means of hinged locations A and B, and presents itself to engage in a hole 8 in the clip 4 of the tool. This engagement impedes movement of the belt clip 4, while the double thickness of the card, formed by the folded tongue 6, maintains pressure on the tab's engagement.

Thus, the card is difficult for a thief to detach from the tool without drawing attention to himself, but not so difficult that a genuine buyer will be put off from further purchase of the brand by a difficult task of separating the measuring tape from the card after the purchase has been made.

Further, the card can display printed information about the product, such as a price ticket, or a security device.

Although only preferred embodiments are specifically illustrated and described herein, it will be appreciated that many modifications and variations of the present invention are possible in light of the above teachings and within the purview of the appended claims without departing from the spirit and intended scope of the invention. Specifically, the present invention is not limited to tests for the presence of lead or cadium.

I claim:

1. A display card for a tool having a belt clip, comprising:

a card of foldable material, slotted so as to define a flap and a tongue therein;

said flap is adapted to admit the belt clip of the tool; and said tongue is adapted to be folded towards said flap, said tongue being hingedly attached to said card and further comprising a tab adapted such that when said tongue is folded towards said flap, the tab of the tongue is inverted.

2. The display card of claim 1, wherein said tab is adapted to engage an aperture in said belt clip when said tongue is inverted and when said belt clip is inserted through said card.

3. The display card of claim 1, wherein said tongue is substantially rectangular in shape.

4. The display card of claim 1, wherein said flap is substantially rectangular in shape.

5. The display card of claim 1, wherein said tongue is hingedly connected to said card at both sides of said tab, said tab and hinged connection situated on a side of the tongue closest to said flap.

6. The display card of claim 1, wherein said tongue is displaced a distance away from said flap approximately equal to a length of said tongue.

7. The display card of claim 1, wherein a width of said tongue and said flap is adapted to be approximately equal to a width of said belt clip.

8. The display card of claim 1, wherein said card further comprises a hole for hanging said card on a hook.

9. The display card of claim 1, wherein said tab is semicircular in shape.

10. The display card of claim 1, wherein said card is made from cardboard.

11. The display card of claim 1, wherein said card as rectangular in shape.

12. A display card for a tool having a belt clip, comprising:

a card of foldable material;

a slot formed in said card, through which slot the belt clip of the tool may pass;

tongue forming means cut in said card for defining a tongue foldable along a line such that the tongue may be folded toward said slot so as to form a double thickness of the card under the belt clip; and means extending from said tongue for engaging with an aperture in the belt clip to retain the belt clip in said card.

13. The display card of claim 12, wherein the tongue extends to the slot when the tongue is folded toward the slot.

14. A method of mounting a tool on a card of foldable material having a slot formed in said card, through which slot a belt clip of the tool may pass; tongue forming means cut in said card for defining a tongue foldable along a line such that the tongue may be folded toward said slot so as to form a double thickness of the card under the belt clip; and means extending from said tongue for engaging with an aperture in the belt clip to retain the belt clip in said card, comprising the steps of:

folding the tongue against the card to form a double thickness while repositioning said engaging means;

passing the belt clip through the slot and over the tongue; and locking the engaging means in the aperture of the belt clip.

15. A method of displaying a tool having a belt clip, said method comprising the steps of:

providing a display card for a tool having a belt clip, comprising a card of foldable material, slotted so as to define a flap and a tongue therein; said flap is adapted to admit the belt clip of the tool; and said tongue is adapted to be folded towards said flap, said tongue being hingedly attached to said card and further comprising a tab adapted such that when said tongue is folded towards said flap, the tap of the tongue is inverted;

folding the tongue towards said flap;

inserting the belt clip of the tool through said flap; and engaging the tab of said tongue with an aperture in said belt clip.

* * * * *